US007258343B2

(12) United States Patent
Hayakawa et al.

(10) Patent No.: US 7,258,343 B2
(45) Date of Patent: Aug. 21, 2007

(54) CARD GAME AND METHODS OF PLAY

(75) Inventors: Kazumoto Hayakawa, Cypress, CA (US); Kentaro Kawashima, Tokyo (JP); Futoshi Tagawa, Tokyo (JP); Makoto Nakamura, Tokyo (JP)

(73) Assignee: Bandai America Incorporated, Cypress, CA (US)

( * ) Notice: Subject to any disclaimer, the term of this patent is extended or adjusted under 35 U.S.C. 154(b) by 331 days.

(21) Appl. No.: 10/898,685

(22) Filed: Jul. 23, 2004

(65) Prior Publication Data

US 2006/0017229 A1 Jan. 26, 2006

(51) Int. Cl.
*N63F 1/00* (2006.01)

(52) U.S. Cl. ..... 273/308; 273/292

(58) Field of Classification Search ..... 273/292
See application file for complete search history.

(56) References Cited

U.S. PATENT DOCUMENTS

| | | | | |
|---|---|---|---|---|
| 2,036,341 | A | 4/1936 | Lemburg | |
| 2,254,545 | A | 9/1941 | Roberts | |
| 2,432,248 | A | 12/1947 | Milone | |
| 2,634,132 | A | 4/1953 | Freedman | |
| 3,274,706 | A | 9/1966 | Friend | |
| 3,471,962 | A | 10/1969 | Klein | |
| 3,815,920 | A | 6/1974 | Carter | |
| 3,871,115 | A * | 3/1975 | Glass et al. | 434/157 |
| 3,891,209 | A * | 6/1975 | Kritzberg | 273/459 |
| 4,176,473 | A | 12/1979 | Rae | |
| 4,637,799 | A * | 1/1987 | Bouchal | 434/236 |
| 5,213,507 | A | 5/1993 | Ozrovitz | |
| 5,435,568 | A | 7/1995 | Black | |
| 5,579,117 | A * | 11/1996 | Arsenault et al. | 358/296 |
| 5,590,880 | A | 1/1997 | Flam | |
| 5,662,332 | A * | 9/1997 | Garfield | 273/308 |
| 5,988,688 | A | 11/1999 | Such | |
| 6,017,034 | A | 1/2000 | Hennessey | |
| 6,142,475 | A * | 11/2000 | Hennessey | 273/296 |
| 6,427,838 | B1 | 8/2002 | Fulda | |
| 6,497,410 | B1 * | 12/2002 | Bernstein et al. | 273/297 |
| 6,554,702 | B2 * | 4/2003 | Mahar et al. | 463/11 |
| 6,601,851 | B1 * | 8/2003 | Sakamoto et al. | 273/308 |
| 6,685,186 | B2 | 2/2004 | Wilson | |
| 6,688,973 | B2 * | 2/2004 | Satloff et al. | 463/1 |
| 6,702,289 | B1 | 3/2004 | Feola | |
| 6,719,292 | B2 | 4/2004 | Lo | |
| 2002/0043764 | A1 * | 4/2002 | Imhof | 273/292 |
| 2003/0052448 | A1 | 3/2003 | Bertrand | |
| 2003/0107173 | A1 * | 6/2003 | Satloff et al. | 273/292 |
| 2003/0137107 | A1 * | 7/2003 | Rubin | 273/292 |
| 2004/0007817 | A1 | 1/2004 | Orbanes | |
| 2004/0036220 | A1 * | 2/2004 | Tanaka | 273/292 |
| 2004/0100021 | A1 | 5/2004 | Chang | |

OTHER PUBLICATIONS

Bandai Co., Ltd., Instructions to Card Game Apr. 2003, Japan.

* cited by examiner

*Primary Examiner*—Eugene Kim
*Assistant Examiner*—Dolores R. Collins
(74) *Attorney, Agent, or Firm*—Lewis Brisbois Bisgaard & Smith LLP; Sanford Astor

(57) ABSTRACT

This invention relates to a card game comprised of at least one warrior card, at least one technique card, at least one power card, and at least one field card. This invention also includes a method of playing said card game, which involves the use of a battle binder.

4 Claims, 4 Drawing Sheets

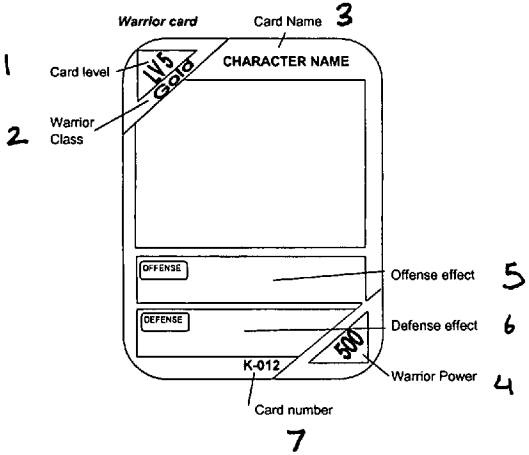
- Fig. 1 -
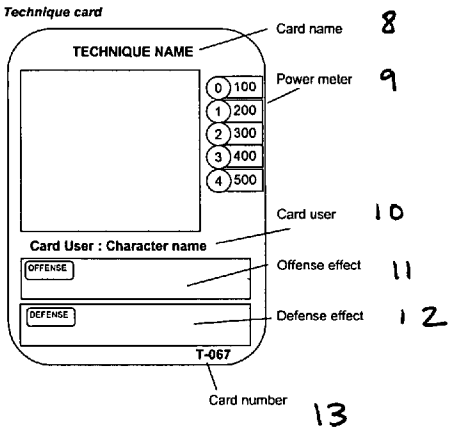
- Fig. 2 -
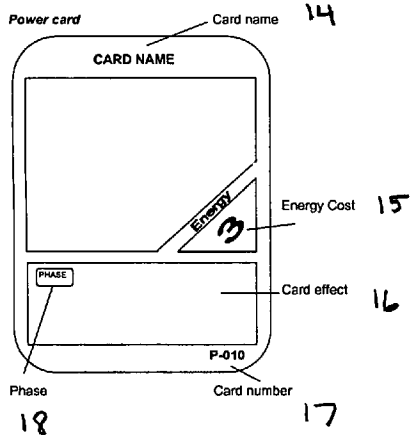
- Fig. 3 -
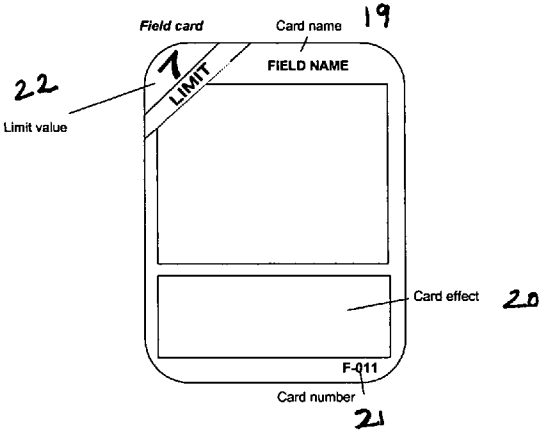
- Fig. 4 -

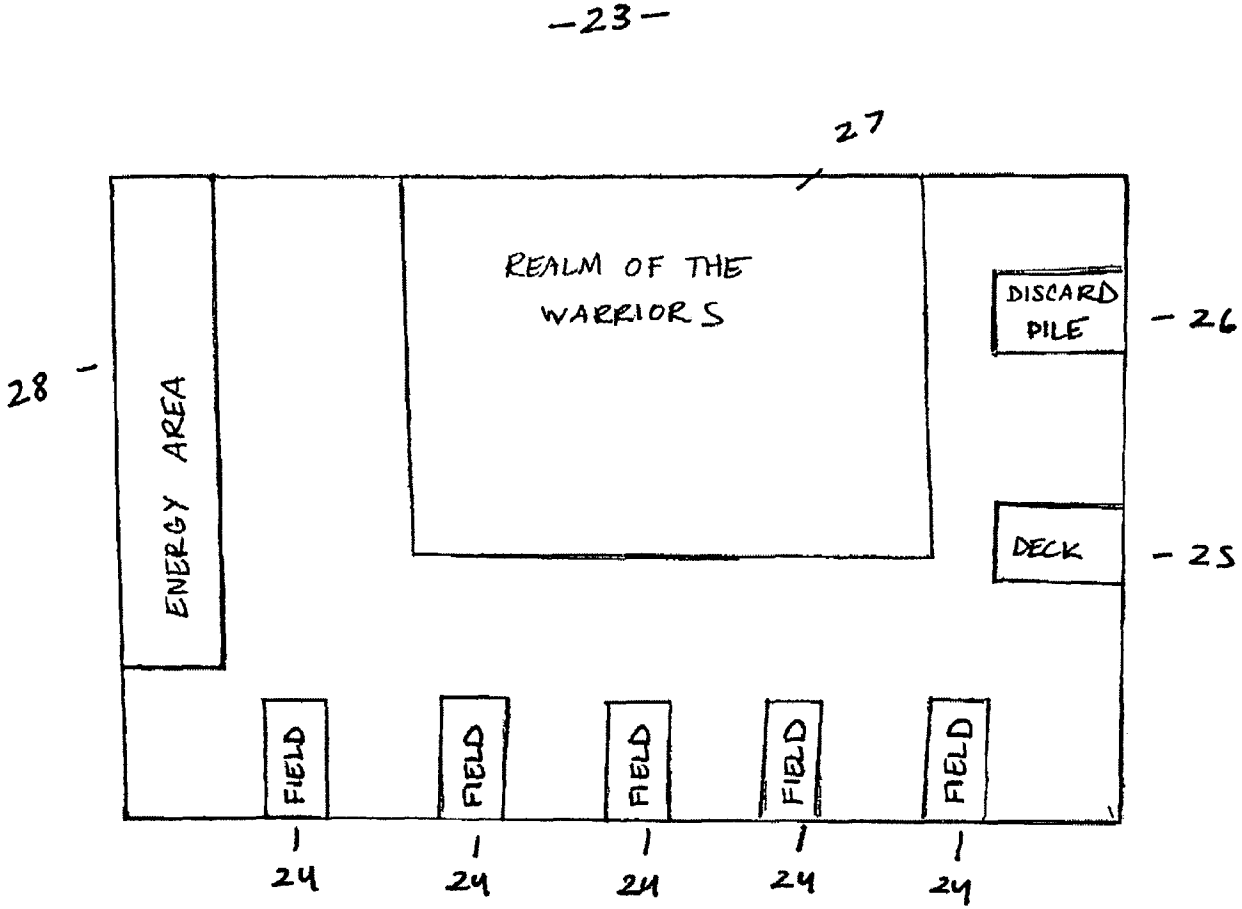
-Fig. 5-

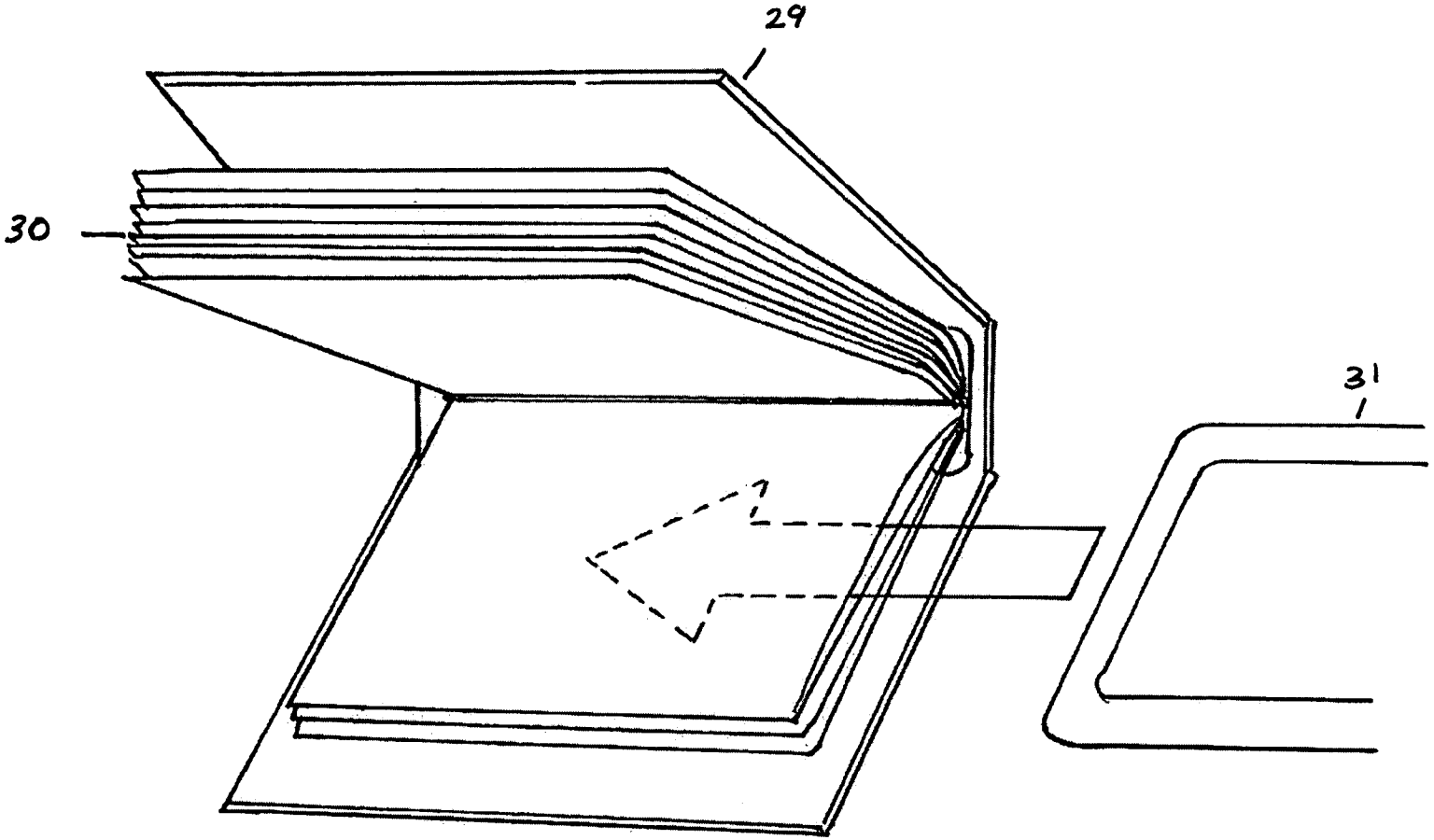
- Fig. 6 -

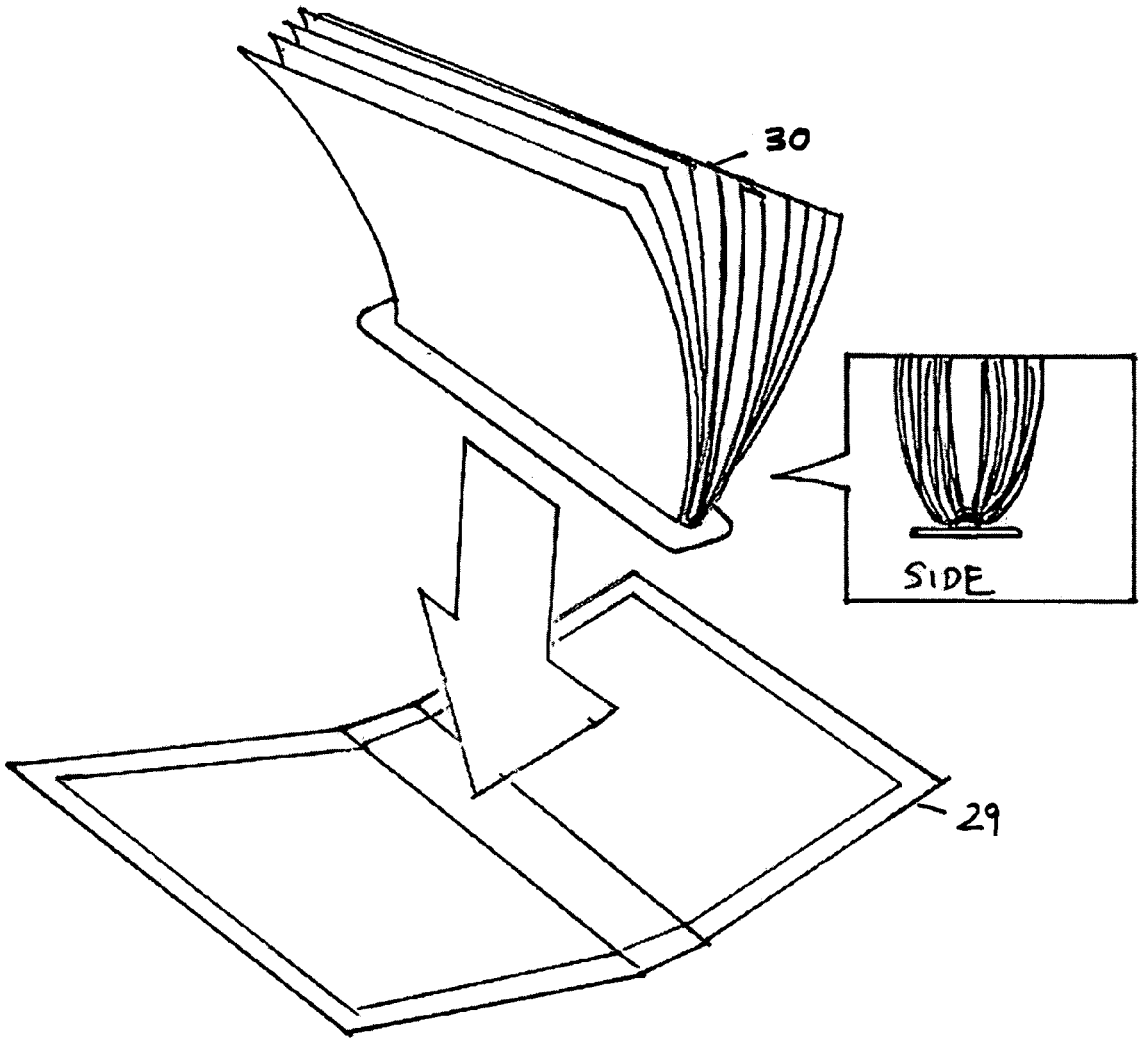
- Fig. 7 -

CARD GAME AND METHODS OF PLAY

BRIEF SUMMARY OF THE INVENTION

The invention relates to a card game and methods of playing a card game. The game simulates battle between warriors that have different abilities and powers. All of the cards have a uniform back side, making said cards indistinguishable from one another on said back side and a face side comprised of the following: warrior cards, technique cards, power cards, and field cards.

The card game can be played with or without a battle binder. The battle binder allows the player to create his strategy before play has begun and the player loads his battle binder according to his intended strategy. The battle binder can also be played with other games such as the game War or other card games where cards are shuffled and played. The battle binder eliminates the step of shuffling playing cards because with the battle binder the player knows the identity of all of his playing cards beforehand, and loads his battle binder based on his predication of how his opponent will play his cards.

BRIEF DESCRIPTION OF THE DRAWINGS

FIG. 1 is a drawing of a warrior card and some of its components.

FIG. 2 is a drawing of a technique card and some of its components.

FIG. 3 is a drawing of a power card and some of its components.

FIG. 4 is a drawing of a field card and some of its components.

FIG. 5 is a drawing of a playmat.

FIG. 6 is a perspective view of a battle binder.

FIG. 7 is another perspective view of a battle binder.

DETAILED DESCRIPTION OF THE INVENTION

This invention includes a card game and methods of play simulating a battle between warriors having various powers and weapons. The game includes a deck of preferably 45 cards, a playmat, and a game manual. The game can be played either with or without a battle binder, which will be discussed further below. There are four card types used in the collectable card system. The back side of the cards are uniform and identical to one another. In a preferred embodiment of the game, the face side of the cards are comprised of the following four types: 1) warrior cards 2) technique cards 3) power cards and 4) field cards. The four card types have the following features:

I. Card Types

A. Warrior Cards

Warrior cards are the cards that the players use to battle one another and gain control over field cards. As shown in FIG. 1, warrior cards contain the following information:

- Card Level 1: This value is used to determine whether a warrior can battle for a particular Field Card. It also represents the Points that the warrior is worth once defeated.
- Warrior Class 2: Used to identify the warrior class of the character.
- Card Name 3: Refers to the name of the warrior.
- Warrior Power 4: The amount of power that this warrior can attack or defend with.

- Offense Effect 5: The effect the warrior card has when it is used for offense.
- Defense Effect 6: The effect the warrior card has when it is used for Defense.
- Card Number 7: every card within a deck will have a different card number.

B. Technique Cards

Technique cards are played in battle to gain a tactical advantage over an opponent. Technique cards can sometimes alter the outcome of a battle because they can increase a warrior's power level. To play technique cards, an energy cost does not have to be paid but may be paid to further increase the warrior's power level. The energy costs are paid in terms of cards, and payment of one energy cost is made by submitting one card from the player's energy area of his playmat. As shown in FIG. 2, technique cards contain the following information:

- Card Name 8
- Power Meter 9: while energy costs are not required to be paid in order to play technique cards, power levels can be increased by paying an energy cost. A chart indicating how much additional power can be added to a warrior card, and the energy cost that must be paid for each power increase is located on the technique card.
- Card User 10: Indicates which warrior or warriors can use the Technique Card.
- Offense Effect 11: The effect the card has when it is used for Offense.
- Defense Effect 12: The effect the card has when it is used for Defense
- Card Number 13

C. Power Cards

Power cards are played in battle to gain a tactical advantage over an opponent. An energy cost must be paid in order to play power cards. As shown in FIG. 3, power cards contain the following information:

- Card Name 14
- Energy cost 15: The number of cards that must be moved from a player's energy area to their Discard Pile to bring the card into play and activate its effects.
- Card Effect 16: The effect the card has when it is played.
- Card Number 17
- Phase 18: The phase of play in which a power card must be played.

D. Field Cards

Field cards represent the place where battles take place. A player's movement of a card to a field card indicates the location where a player intends to battle. As shown in FIG. 4, field cards contain the following information:

- Card Name 19
- Effect 20: The effect that this card has on the Warriors involved in a battle over this Field Card, or its effect on the results of that battle.
- Card Number 21.
- Limit value 22: The level of both players' warrior cannot exceed the limit value indicated on a field card where the players intend to battle.

II. Playmat

Each Player participating in the game has his own playmate 23 and deck of cards. As shown in FIG. 5, the playmats are organized in the following manner:

- Field area 24: Formed by placing two playmats together. This is the area where battles take place
- Deck area 25: A player's shuffled Deck is placed face down here. Cards drawn into a player's hand are taken from the Deck.

Discard Pile 26: Discards are placed face up in this area.

Realm of Warriors area 27: warrior cards are placed in this area during the Deploy warriors phase. Warrior cards may be moved to or from this area during this Move Phase.

Energy Area 28: Any type of card may be placed face down in this area during the energy phase to be used to pay future energy costs.

III. Play

There are two players in the game, an offensive player and a defensive player. The first player to win the agreed upon number of points wins a contest and the first player to win an agreed upon number of contests wins the game. Before beginning play, one of the players flips a coin or uses some other method agreed upon between the players to determine who will be the offensive player first. The player who is on Offense for the first Contest will then be on Defense in the following Contest. Players continue to alternate between Offense and Defense each Contest until a Game winner is determined.

In the preferred embodiment of the invention, there are 45 cards in a deck, with 5 of them being field cards. The offensive player removes all field cards from his deck and does not play them. The defensive player removes the five field cards from his deck and places them face down in the field card area of his playmat. Only the defensive player knows the identity of the field cards placed face down in the field card area. Decks should be shuffled. The Decks are then placed face down in the Deck area of each player's playmat.

IV. Phases of Play

There are 5 Phases of gameplay.

1. Draw Phase

On the first turn, both players draw 5 cards. In every subsequent turn, the player whose turn it currently is draws cards into his hand until it consists of 5 cards.

2. Energy Phase

Each player, with offense going first, can play as many cards as they'd like, of any type, from their hand to the energy area of the playmat. These cards make up the energy a player will have stored when the battle between the warriors takes place. The cards are placed face down in the energy area. The importance of these cards will be discussed further when the battle phase is explained.

3. Deploy Warriors Phase

Each player (Offense first) can choose to prepare a warrior for battle by placing their warrior card FIG. 1 face down in the realm of warriors area of the playmat. Each player is limited to playing 1 warrior card to this area per turn. Each player may also choose not to play any warrior cards at all.

A maximum of five warrior cards are allowed to be in each player's realm of warriors area at the end of the Move Phase.

4. Move Phase

Each player (offense first) may choose to move any number of their warriors from the realm of warriors area 27 to a field card FIG. 4, or from a field card back to the realm of warriors area during this phase, but each warrior card can only be moved once per turn. In addition, a warrior card cannot be moved from one field card to another field card. The warrior cards remain in their current orientation (face up or face down) during this phase.

Warriors that are moved to a field card are preparing to do battle over that card. Warriors that are moved to the realm of warriors area are pulling back from an upcoming battle, or are being prepared to move to a new field card on a subsequent turn.

Warrior cards can be moved onto a field card that is already occupied by another of the same player's warriors, provided that the sum of the warriors' levels does not exceed the field card's limit value indicated on the cards.

Warrior cards don't have to be moved at all during this phase. For example, a player may choose to leave a warrior that has won a previous battle on a particular field card in order to achieve yet another battle victory later.

5. Battle Phase

Each player simultaneously turns over all face down cards, both warrior cards and field cards, that will be involved in the Battle Phase. Face down field cards not involved in a battle, warrior cards in the realm of warriors area, and cards in the Energy area 28 remain face down.

If more than one field card will be involved in a battle this turn the offensive player chooses the order of the battles. Each battle is contested in the following steps:

a) Level Check

Each player compares the level of the warrior involved in the battle (or the sum of their warriors' levels, if one player has multiple warriors contesting a battle) to the limit value printed on the field card.

If the level of the offensive player's warrior(s) exceeds the limit 22 printed on the field card, the battle does not take place. Instead, the warrior(s) are pulled back to the realm of warriors' area. If the Defensive player's warrior(s) level 1 exceed the Field Card limit, the defensive player's warrior card(s) are placed in the discard pile of the defensive player's playmat and the field card is gained by the offensive player and added to the offensive player's point total.

b) Check for Card Effects

Both warrior cards and field cards have card effects 5, 6, 20 which may alter the outcome of a battle. Both players should check the card effects of their own cards, and communicate any relevant card effects to their opponent. Card effects vary widely, and some may only be able to be applied after a specified battle outcome.

Regarding the card effects of the warrior cards, only the "Offense" effect 5 can be applied to the Offensive player, and the "Defense" effect 6 may be applied to the Defensive player.

c) Compare Warrior Power

Both players compare the warrior power 4 of their warrior against the warrior power of their Opponent's Warrior. Remember to apply any card effects from the previous Step that alter the power of the warriors. The warrior card with the highest power at the end of the battle will be the winner of that battle.

If a player is using more that one warrior in a battle, the sum of the warriors' power equals the total power.

d) Play Technique or Power Cards

Both players may choose to play technique or power cards at this point to try to alter the outcome of the battle in their own favor. Each player (Offense first) places as many power cards or technique cards as they wish face down in the Realm of Warriors area, directly below where the battle that is taking place. Once both players have finished placing these cards in the realm of warriors area, they are simultaneously turned face up. Both players must pay the required energy costs (if any), indicated on the power and/or technique cards in order to play them.

In addition, many technique or power cards specifically designate which warriors can use them. Power cards also designate the Phase 18 of the turn in which they must be played.

Power cards have a set energy cost and effect. Technique Cards do not. However, the power increased by a technique card can be greatly increased by paying energy costs. Each player (Offense first) can choose to pay energy costs to play technique cards to further increase their power. The chart on the side of the technique card indicates the energy costs required to increase the power level of a warrior by various amounts.

If a player is attacking or defending with multiple warriors, general card effects that do not specifically designate the warriors they affect, are applied to each warrior. Also, a player using multiple warriors who loses a battle loses ALL the warriors involved in that battle.

e) Determine Battle Outcome

Once Step d is completed, players compare the final power of the warriors involved in the battle. The player whose warrior or warriors have the highest power wins the battle.

If the battle is a tie, nothing happens. All cards involved in that battle remain where they are; and Step f is skipped.

f) Apply Battle Outcome

The winner of the battle receives points equal to the level value of the warrior(s) he has defeated. The winner takes his opponent's defeated warrior(s) and places them in a point area that may be made to the left of the playmat (the cards are returned to their owner at the end of each Contest).

The losing defensive player also takes a face down card from the top of his deck and puts it underneath and perpendicular to the field card where the battle has just taken place. This is known as field damage.

When the field damage (ie, the number of cards below the field card) equals the limit value 22 of a particular field card, the face down field damage cards are discarded, and the winning offensive player takes the field card and places it in his point area, where its limit counts towards points needed to win a contest, just as the warrior cards do.

If the offensive player's warrior card is uncontested in a battle over a field card, the defensive player places a field damage card under the field card. No points are gained by either player, unless the field damage equals the limit of the particular field card.

If a field card has only a defending warrior card and no offensive warrior card, no battle takes place there.

Finally, any technique and/or power of cards that have been used in this battle are sent to the Discard Pile.

The above steps are repeated until all of the battles are resolved, and then the phases are repeated, with each of the players drawing five cards. The first player to gain the set number of points agreed upon between the players wins the Contest. The following two ways are how points are gained: (1) Defeating an opponent's warrior card in battle. (2) Gaining control of a field card by inflicting field damage equal to the limit value of a field card.

6. Decking Penalty

The term "decking" refers to a player's deck being completely used up before a contest has been completed. In this battle card game, the player who has been decked is allowed to reshuffle his discard pile to form a new deck. However, a decking penalty is incurred. Before the discard pile is reshuffled, the decked player must choose 3 cards randomly from the energy area of his playmat and add them to the discards.

If a player that has been decked cannot pay the 3 card decking penalty, play continues. However, that player must skip the draw phase of his turn for the remainder of the Contest.

V. Play with Battle Binder

The battle card game can also be played using a battle binder 29. A battle binder is comprised of a book containing multiple transparent sleeves 30 into which playing cards 31 can be inserted. Once the defensive player is determined in the same manner as described above, the field cards are removed from each of the players decks and the defensive player places the field cards face down on his playmat. Then the players each load their battle binder with their playing cards in the strategic order in which they intend to play the game. Once the battle binders are loaded, each player must play his cards in the exact order in which they are loaded in his book. The game is played until the last page of the battle binder is reached.

The battle binder can also be played for other card games. For example, the battle binder can be used to play the game War. War, played in the conventional manner, entails shuffling a deck of cards, dealing a hand to each player, and each player playing which ever card he thinks will be higher than his opponents. Whoever has the highest card wins. Playing War with the battle binder, eliminates the step of shuffling and dealing cards, but rather each player receives a set of cards, and loads his battle binder in the strategic order in which he predicts play will take place. Once each player has loaded his book, cards are withdrawn from each players book in the exact order in which they are placed. Play can also proceed with each page of the book being turned and the corresponding page of the opponent's battle binder being compared. The player who's page is higher than the corresponding page of his opponent's battle binder wins.

The invention claimed is:

1. A card game wherein all of the cards have a uniform back side, making said cards indistinguishable from one another on said back side and a face side comprised of the following:

- at least one warrior card wherein said warrior cards contain the following information:
  - a card level feature, which is used to identify whether a warrior can battle for a particular field card;
  - a warrior class feature, used to identify the warrior class of a warrior card;
  - a card name feature;
  - a warrior power feature, indicating the amount of power the warrior can attack or defend with;
  - an offense effect feature, indicating the effect a warrior card has when it is used for offense;
  - a defense effect feature, indicating the effect a warrior card has when used for defense;
- at least one technique card wherein said technique cards contain the following information:
  - a card name feature;
  - a power meter feature indicating how much additional power can be added to a warrior card, and a cost that must be paid for each power increase;
  - a card user feature, indicating which warrior can use the technique card;
  - an offense effect feature, indicating the effect a technique card has when used for offense;
  - a defense effect feature, indicating the effect a technique card has when used for defense;
- at least one power card with said power cards containing the following information:

an energy cost feature, which is the number of cards that must be moved from a player's energy area to said player's discard pile to bring the card into play and activate its effects;

a card effect feature, which is the effect the card has when it is played;

a phase feature indicating a phase the card must be played in;

a card name feature;

at least one field card, whereby said field cards contain the following information:

a limit value that a player's warrior level cannot exceed;

a card name feature;

an effect feature indicating the effect a field card has on a warrior involved in a battle over said field card, or its effect on the results of said battle.

2. The card game of claim 1 wherein each player has a playmat comprising:

a field area, a deck area, a discard pile area, a realm of warriors area, an energy area and a point area.

3. A method of play of a card game played between two players, using the cards described in claim 1, comprising the following steps:

a. One of said players flips a coin or uses any other method agreed upon between said two players to determine which of said players will be an offensive player and which will be a defensive player;

b. Each of said players possesses a deck of said cards and the playmat described in claim 2;

c. Once the offensive player is determined, said offensive player removes all field cards from his deck and does not play them;

d. Said defensive player also removes all field cards from his deck but places them face down in the field card area of his playmat;

e. Said players shuffle and cut their deck of cards, placing them face down on a deck area of their playmat and said players draw 5 cards from their deck to form a playing hand;

f. Next said players play as many cards from said hand as each player desires in said energy area of their playmat;

g. Afterwards, each player may select a warrior card, from said hand, for battle by placing it face down in said realm of warriors area of his playmat; a maximum of 5 warriors per player may be placed in said player's realm of warriors area at any one time;

h. with said offensive player moving first, each of said players may choose to move a warrior card from said realm of warriors region of their playmat to one of said field cards on said defensive player's playmat;

i. each of said players simultaneously turns over their cards that they intend to involve in a battle; a card level indicated on said offensive player's warrior card is compared to a limit value indicated on a field card where said battle is taking place; if said card level of said offensive player's warrior card exceeds said limit value of said field card, the battle does not take place; if a card level of said defensive player's warrior card exceeds said field card's limit value, the defensive player's warrior card(s) are placed in the discard pile of the defensive player's playmat and the field card is gained by the offensive player and added to the offensive player's point total;

j. if said card level of said offensive player and said defensive player does not exceed said limit value of said field card, battle will take place and a power feature of said players' warrior cards are compared, as well as an offense effect and a defense effect written on said players' warrior cards;

k. a technique card or a power card may be played by said players to affect the outcome of the battle if said players have any of said cards in their hands; a cost or requirement must be met in order to play said technique cards and said power cards, said costs and said requirements are indicated on said cards and must be met in order to play said cards;

l. after any of said power cards and said technique cards are played, a final power level of said warrior cards in said battle are compared and a winner is determined; the player with the highest power level wins said battle;

m. a winner of said battle receives points equal to said defeated warrior's card level;

n. battles are repeated as set forth in steps a through m above until a player obtains the number of points required for winning.

4. A method of play for said card game of claim 3 using a battle binder, wherein step (e) is eliminated and replaced with the following steps:

a. each player receives a battle binder;

b. said players load their battle binder in the order in which they intend to play their cards, being careful not to let their opponent see the order;

c. once each player loads his battle binder, 5 cards are drawn from said battle binder prior to beginning play;

d. the game is completed when the last page of the battle binder is reached.

* * * * *